US008479613B2

(12) United States Patent
Saito et al.

(10) Patent No.: US 8,479,613 B2
(45) Date of Patent: Jul. 9, 2013

(54) FASTENING TOOL

(75) Inventors: Manabu Saito, Tokyo (JP); Tatsuo Nakahata, Tokyo (JP); Hideharu Takahashi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 151 days.

(21) Appl. No.: 13/090,705

(22) Filed: Apr. 20, 2011

(65) Prior Publication Data

US 2011/0265610 A1 Nov. 3, 2011

(30) Foreign Application Priority Data

Apr. 28, 2010 (JP) ..... 2010-103445

(51) Int. Cl.
*B25B 13/48* (2006.01)

(52) U.S. Cl.
USPC ..... 81/55

(58) Field of Classification Search
USPC ..... 81/55, 56, 57.14, 57.3
See application file for complete search history.

(56) References Cited

U.S. PATENT DOCUMENTS

| | | | | |
|---|---|---|---|---|
| 4,538,483 | A | 9/1985 | Batten | |
| 5,305,666 | A | 4/1994 | LaTorre | |
| 5,343,784 | A | 9/1994 | Neuhaus | |
| 5,553,519 | A * | 9/1996 | Pettit, Jr. | 81/56 |
| 7,287,447 | B2 * | 10/2007 | Pettit, Jr. | 81/56 |
| 7,600,452 | B2 * | 10/2009 | McDaniel | 81/467 |
| 2007/0107557 | A1 * | 5/2007 | Pettit | 81/56 |
| 2010/0095810 | A1 * | 4/2010 | MacArthur et al. | 81/55 |
| 2011/0132148 | A1 * | 6/2011 | Stoger | 81/55 |

FOREIGN PATENT DOCUMENTS

JP 2006-155319 6/1994

* cited by examiner

*Primary Examiner* — David B Thomas
(74) *Attorney, Agent, or Firm* — Konomi Takeshita

(57) ABSTRACT

This fastening tool supports a key wrench such that it cannot rotate at a location where a hexagonal hole on the tip end part comes in contact with a nut, so that even though the key wrench is pressed backward as a pin is screwed into the nut, a key wrench holder remains in a state of contact with the nut. After the pin has been screwed into the nut, the nut is twisted off at a weak section. The further the pin is screwed into the nut, the key wrench holder supports the key wrench at a location closer to the pin, which keeps the amount of torsional deformation of the tip end part of the wrench small, and thus makes it possible to securely engage with the pin, and in the final state of the fastening work, it is possible to completely twist off the twist-off type nut, which requires a large torque.

6 Claims, 8 Drawing Sheets

FASTENING TOOL

CROSS REFERENCE TO RELATED APPLICATION

This application claims priority under 35 U.S.C. 119 based upon Japanese Patent Application Serial No. 2010-103445, filed on Apr. 28, 2010. The entire disclosure of the aforesaid application is incorporated herein by reference.

FIELD OF THE INVENTION

The present invention relates to a fastening tool that screws together and fastens a pin and nut.

BACKGROUND OF THE INVENTION

As is also disclosed in U.S. Pat. No. 4,538,483, U.S. Pat. No. 5,305,666 and Japanese Patent Publication No. H06-155319, a fastening member comprising a pin having a hole on the tip end surface thereof for engaging with a tool, and nut that is screwed on to the pin is used. Such a fastening member is illustrated in FIG. 9.

As illustrated in FIG. 9, the fastening member comprises a pin 50 and nut 60. The pin 50 comprises a head section 51 and a shaft section 52. Male screw threads 53 are formed around the surface of the shaft section 52, and a tool engagement hole 54 is formed on the tip end surface of the shaft section 52. The tool engagement hole 54 is a hexagonal hole and a hexagonal wrench engages with the tool engagement hole 54.

The nut 60 comprises a female thread section 61 that screws onto the male thread section 53, and a tool engagement section 63 having an outer perimeter shape that engages with a fastening tool such as a wrench, the female thread section 61 and the tool engagement section 63 being connected via a weak section 62 that could be fractured by a shear force. This weak section 62 is achieved by having a smaller cross-sectional area than the female thread section 61 and tool engagement section 63, with this weak section 62 fracturing by applying a torque between the female thread section 61 and tool engagement section 63, and as a result, the tool engagement section 63 separates from the female thread section 61. The female thread section 61 remains screwed and fastened to the pin 50.

The simplest construction of a fastening tool for performing the fastening work of the fastening tool above is a key wrench that engages with the tool engagement hole 54 of the pin 50 and a wrench that engages with the tool engagement section 63 of the nut 60. However, a condition of this tool is that the key wrench that engages with the pin 50 does not interfere with the wrench that engages with the nut 60. In other words, the wrench that engages with the nut 60 has an engagement section that is open such as an open-end wrench, or in the case of a socket wrench, a through hole through which the key wrench passes is necessary.

By relatively rotating both of these wrenches, it is possible to perform fastening work by screwing together the engaged pin 50 and nut 60.

Instead of the simple key wrench and socket wrench being separate tools, a fastening tool having construction in which both of these wrenches are rearranged and integrated is also used (U.S. Pat. No. 4,538,483, U.S. Pat. No. 5,305,666, Japanese Patent Publication No. H06-155319).

A power-driven tool is disclosed in U.S. Pat. No. 4,538,483, a power-driven and manual tool is disclosed in U.S. Pat. No. 5,305,666, and a manual tool is disclosed in Japanese Patent Publication No. H06-155319.

Each of these tools has a socket wrench that engages with the nut (60) and a key wrench that engages with the pin (50 in FIG. 9 of this specification) or a part that holds the key wrench.

The manual tool disclosed in Japanese Patent Publication No. H06-155319 has basic construction of a combination of a ratchet, socket wrench, and an L-type key wrench. Using a commercially available wrench is as the L-type key wrench, the long end of the wrench must be inserted inside the ratchet and socket wrench. Therefore, the portion of the wrench which is held by hand is short, making it difficult to apply force to the L-type key wrench. In order to perform work comfortably, a separate special tool is necessary.

The portion of the L-type key wrench that is inserted inside the ratchet and socket wrench is not held so as not to rotate during the work. Therefore, when performing fastening work, torsion stress occurs along the entire length of the L-type key wrench, and the amount of torsional deformation could be large.

In the power-driven tool that is disclosed in U.S. Pat. No. 4,538,483 and U.S. Pat. No. 5,305,666, the hexagonal shaped tip end part that engages with the pin (36 in U.S. Pat. No. 4,538,483, 114 in U.S. Pat. No. 5,305,666) is inserted in a hexagonal hole of a cylindrical part (38 in U.S. Pat. No. 4,538,483, 98 in U.S. Pat. No. 5,305,666) and held such that it cannot rotate. This cylindrical part passes through the tip portion of a nut runner, which turns the nut with power, and protrudes out the opposite side, and is restrained by a spring (66 in U.S. Pat. No. 4,538,483, 138 in U.S. Pat. No. 5,305,666) such that it can move in the axial direction, but cannot rotate. The reason that this cylindrical part is capable of moving in the axial direction with respect to the nut runner is that as the pin and nut are screwed and rotated in the tightening direction, the tip end part that engages with the pin must move back with respect to the pin and nut runner. The reason that this cylindrical part is restrained such that it cannot rotate with respect to the frame (non-rotating part) of the nut runner is that when rotating the nut, the pin is fixed so that it does not rotate with the nut.

Naturally, in the tool disclosed in U.S. Pat. No. 4,538,483 and U.S. Pat. No. 5,305,666, a special tool, which includes the hexagonal tip end part that engages with the pin, becomes necessary.

However, even with the conventional technology above, there were further problems such as below. The tip end part that engages with the pin and the cylindrical part that supports this such that it cannot turn are integrated and move in the axial direction together. Therefore, regardless of the progressive stage of the fastening work, the distance between the location of the tip end that receives torque from the pin of this tip end part, and the location where the tip end part is supported by the cylindrical part so that it cannot turn does not change. Therefore, in the last half of the fastening work, particularly in the stage of twisting off the nut, even when a large torque load is applied to the tip end part that engages with the pin, torsional stress occurs along the length in the axial direction as at the start of the fastening work, so naturally the amount of torsional deformation becomes large.

In other words, in the conventional technology, it is not possible to employ construction of firmly holding the tip end part that engages with the pin at a closer location to the pin.

As disclosed in U.S. Pat. No. 4,538,483, even in the case of construction in which the tip end part of the cylindrical part (38 in U.S. Pat. No. 4,538,483) is inserted into the nut at the start of the fastening work, as the fastening work proceeds, this cylindrical part moves back and comes out from inside the nut, and because this cylindrical part is formed such that it is thin enough to be inserted in the nut, it cannot display sufficient torsional rigidity. Therefore, it is not possible to employ construction in which the tip end part that engages with the pin is firmly held at a location closer to the pin.

As the amount of torsional deformation of the tip end part that engages with the pin becomes large, the strain that occurs at the location where the tip end part engages with the pin becomes large, so the possibility that the engagement between the tip end part and the pin will be lost becomes high. Therefore, by the tip end part scraping the inside of the tool engagement hole, there is a possibility that the engagement will gradually become insufficient, and there is also a possibility that twisting off the nut will become impossible.

Moreover, in the power-driven tool disclosed in U.S. Pat. No. 4,538,483 and U.S. Pat. No. 5,305,666, the tip end part that engages with the pin and the cylindrical part that holds the tip end part are held such that they cannot rotate with respect to the frame (non-rotating part) of the nut runner, so in order to find the angle at which the tip end part engages with the tool engagement hole of the pin, the entire nut runner that includes said mounted tools must be rotated around the pin shaft. The weight of the nut runner is large and engages with the nut via a socket wrench. Therefore, it is difficult to know by feeling of the hand whether or not the tip end part is engaged with the tool engagement hole of the pin.

SUMMARY OF THE INVENTION

Taking into consideration the above mentioned things with the conventional technology, it is the object of the present invention to provide a fastening tool that screws together and fastens a pin having a tool engagement hole on the tip end surface thereof and a nut that screws onto that pin by relatively rotating the pin and nut, and that as the fastening work proceeds, is capable of firmly holding the tip end part that engages with the pin at a location closer to the pin.

According to a first embodiment of the present invention for achieving the purpose described above, there is provided a fastening tool for rotating a nut in a specified rotational direction relative to a pin, by engaging with the pin and the nut, the pin having a male thread section and the nut being screwed on to the male thread section of the pin, the pin further having an engaging portion provided at a tip end surface in an axial direction of the male thread section, the fastening tool comprising:

a rotational member having a through hole extending along a rotational axis of the nut, the through hole having an opening on one end and an opening on the other end, the opening on the one end of the through hole configured to house the nut such that the one opening on the one end engages with the nut in the specified rotational direction and the engaging portion of the pin exposes in the through hole;

a pin engagement member, inserted into the through hole of the rotational member from the opening on the other end, for engaging with the engagement portion of the pin exposed inside the through hole;

a tool main body supporting the rotational member coaxially with the nut; and a one-way mechanism, attached to the tool main body, for supporting the pin engagement member coaxially with the nut, the one-way mechanism restricting the pin engagement member from rotating toward the specified rotational direction, and allowing the pin engagement member to rotate toward a direction opposite to the specified rotational direction, wherein the tool main body rotates the nut relative to the pin by driving the rotating member toward the specified rotational direction with respect to the pin engagement member.

According to a second embodiment of the present invention for achieving the purpose above, there is provided the tool according to the first embodiment, wherein the pin engagement member comprises:

a cylindrical member supported coaxially with the nut by the one-way mechanism; and a key wrench that is inserted through the cylindrical member in an axial direction of the cylindrical member and engages with the cylindrical member in the specified rotational direction, and the key wrench that engages with the engagement portion of the pin exposed inside the through hole of the rotating member.

According to a third embodiment of the present invention for achieving the purpose described above, there is provided the tool according to the second embodiment, wherein a part of the key wrench protrudes from the cylindrical member, and the key wrench and cylindrical member are capable of rotating toward the direction opposite to the specified rotational direction by manually operating the part of the key wrench.

According to a fourth embodiment of the present invention for achieving the purpose described above, there is provided the tool according to the second embodiment, wherein the cylindrical member is arranged so that the cylindrical member comes in contact with the nut in the axial direction of the cylindrical member when the rotating member houses the nut.

With the present invention, the cylindrical part that supports the key wrench such that it cannot rotate is capable of moving in the axial direction with respect to the key wrench, however is unable to move in the axial direction with respect to the rotating section. Therefore, even though the key wrench moves back as the fastening work proceeds, this cylindrical part does not move back together with the key wrench, and remains together with the rotating section without the distance from the nut changing. Consequently, as the fastening work proceeds, it is possible to securely support the key wrench that is engaged with the pin at a closer location to the pin.

Therefore, the amount of torsional deformation of the tip end part of the key wrench can be kept small, and the key wrench can be made to securely engage with the pin.

Furthermore, by the rear end section of the key wrench extending to the outside such that it can be rotated, it is possible to rotate and operate the key wrench in the direction allowed by the one-way mechanism independent from the nut rotating tool. This has the effect of improving the workability of the work of engaging the key wrench in the tool engagement hole of the pin, and the work of checking whether or not the key wrench is engaged with the tool engagement hole of the pin.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 8A illustrates a relatively early stage, and FIG. 8B illustrates a stage at which the fastening work has further progressed from that illustrated in FIG. 8A.

DETAILED DESCRIPTION OF THE INVENTION

An embodiment of the present invention is explained below with reference to the drawings. The following is an embodiment of the present invention and does not limit the invention.

This embodiment is a fastening tool that screws together and fastens the pin 50 and nut 60 that were described above with reference to FIG. 9 by rotating them relative to each other. In this embodiment, the nut 60 is a hexagonal nut.

Figure 1:
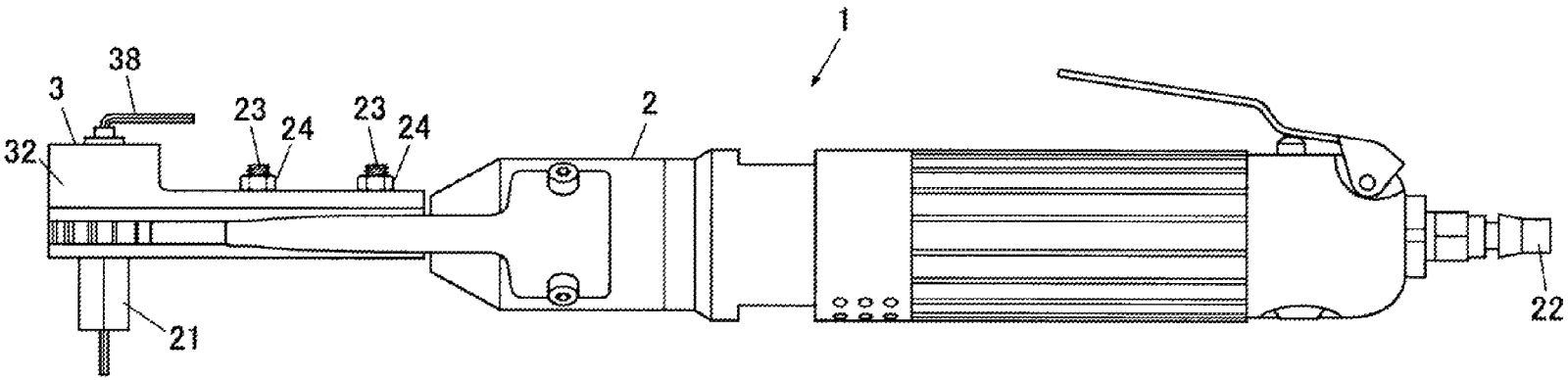
FIG. 1 is an overall side view of a fastening tool of an embodiment of the present invention.

As illustrated in FIG. 1, the fastening tool 1 of this embodiment comprises a nut runner 2, a socket wrench 21 that is used by being mounted on the nut runner 2, and a pin support device 3 for supporting the pin 50 with a key wrench.

Figure 2:
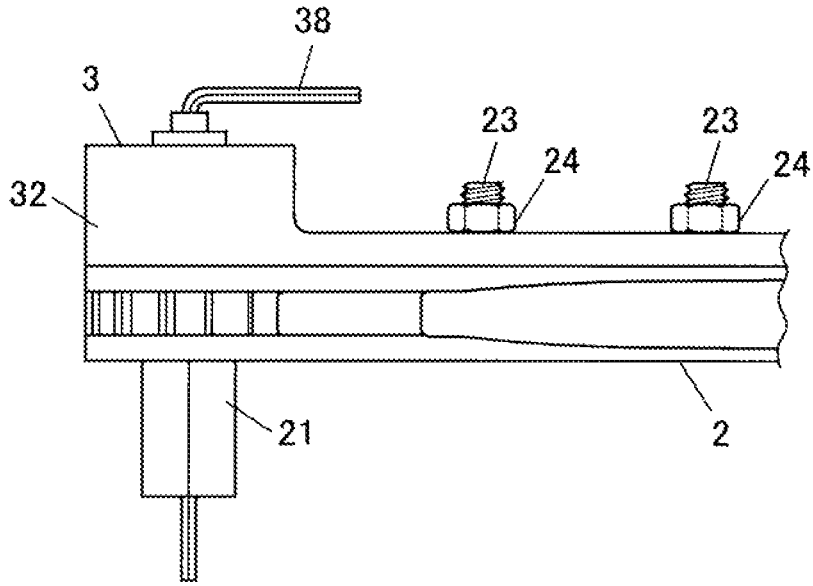
FIG. 2 is an enlarged diagram of the output end section of the fastening tool illustrated in FIG. 1.

The nut runner 2 is a nut runner that is typically used industrially. A pressurized-air supply pipe is connected to an air supply port 22 of the nut runner 2. The nut runner 2 uses the pressurized air that is supplied from the air supply port 22 to rotate and drive a rotating section (not illustrated in the figure) that is equipped inside an output end section that is illustrated in FIG. 2.

The rotating section of the nut runner 2 has a hexagonal through hole that is coaxial with the rotational axis of the rotating section. In order to be able to correspond to various kinds of nuts, a socket wrench 21 is inserted and mounted in this hexagonal through hole. The nut runner 2 and socket wrench 21 form a nut rotation tool.

Figure 3:
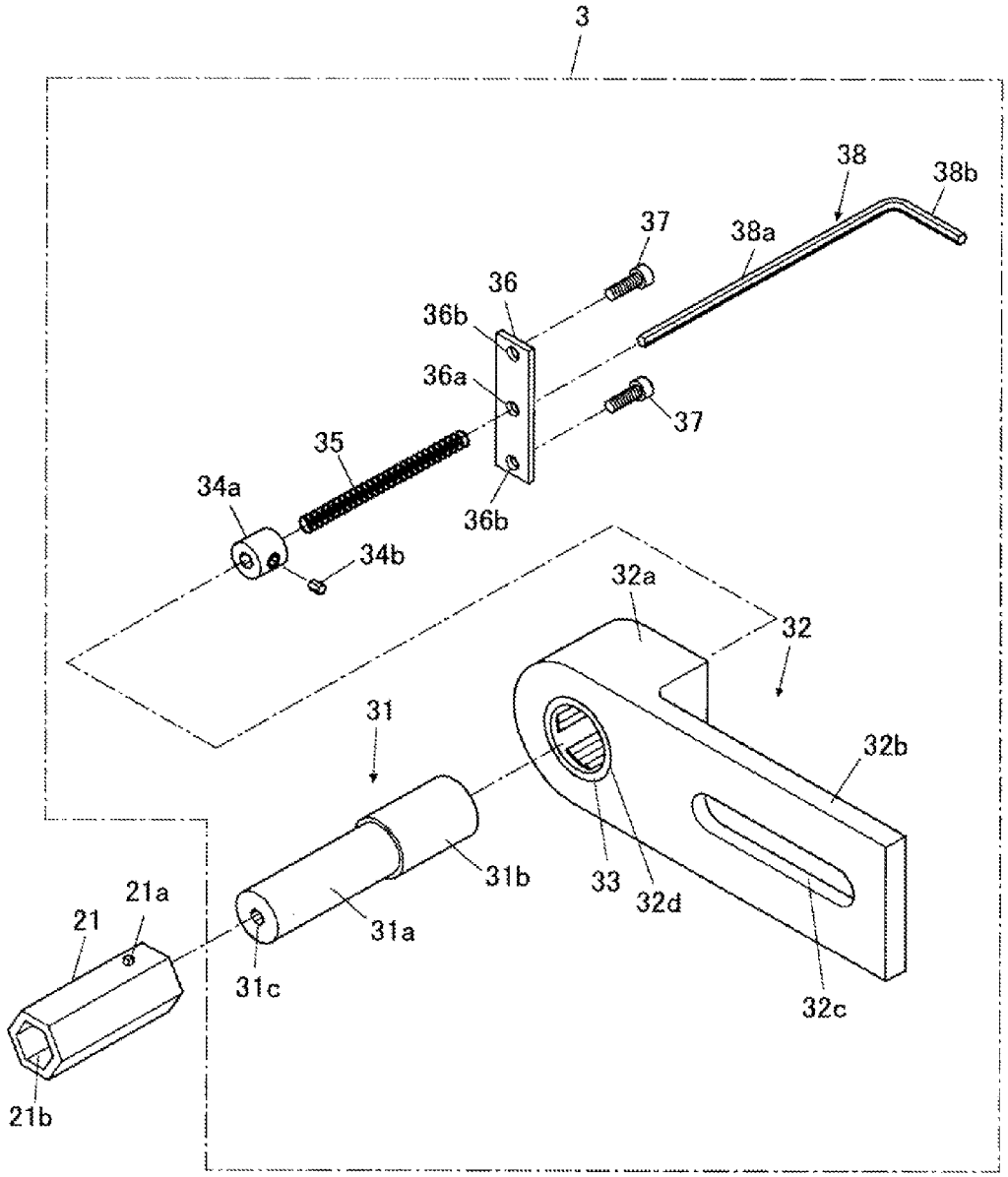
FIG. 3 is a partial perspective view of the mounted parts of the fastening tool of an embodiment of the present invention.
Figure 4:
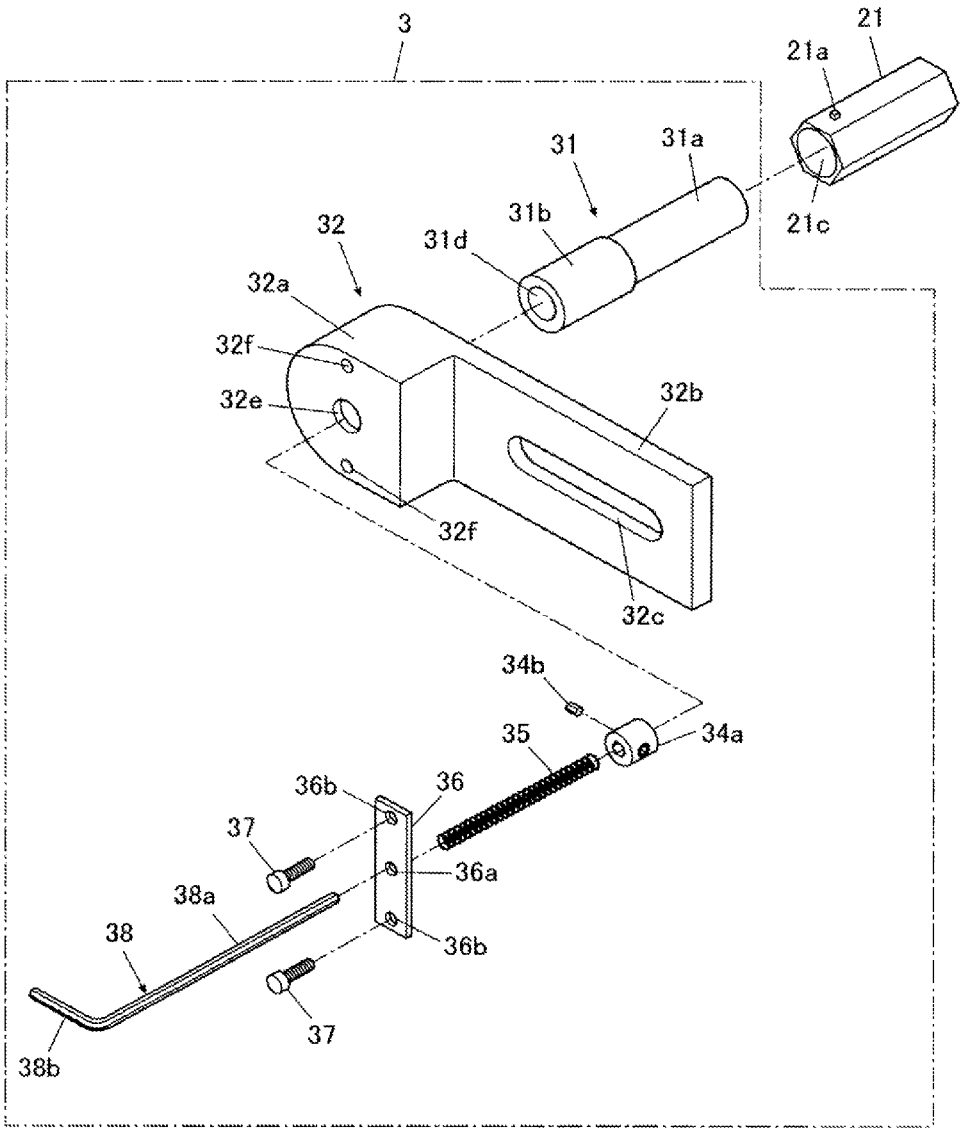
FIG. 4 is a partial perspective view of the mounted parts as seen from a different direction.
Figure 5A:
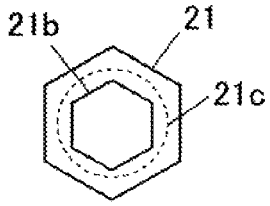
FIG. 5A is a top view.
Figure 5B:
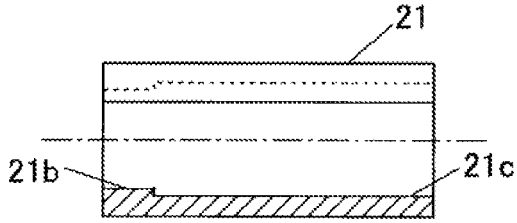
FIG. 5B is a partial cross-sectional side view of a socket wrench of the fastening tool of an embodiment of the present invention.

As illustrated in FIG. 3 to FIG. 5, the socket wrench 21 has a hexagonal outer shape, and an engagement protrusion 21*a* that is formed on one of the surfaces functions as a stopper when mounted.

The socket wrench 21 has a through hole, and on one end section of that through hole there is a hexagonal nut engagement hole 21*b* that engages with the nut 60, and in the remaining section there is a circular hole 21*c* having a larger diameter than that of the nut engagement hole 21*b*.

As illustrated in FIG. 3 and FIG. 4, the pin support device 3 comprises a key wrench holder 31, a bearing holder 32, a one-way bearing 33, a set collar 34*a*, a set screw 34*b*, a coil spring 35, a spring restraining plate 36, cap bolts 37, 37 and an L-shaped hexagonal key wrench 38.

Figure 6A:
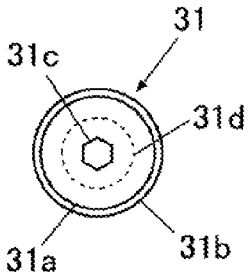
FIG. 6A is a top view.
Figure 6B:
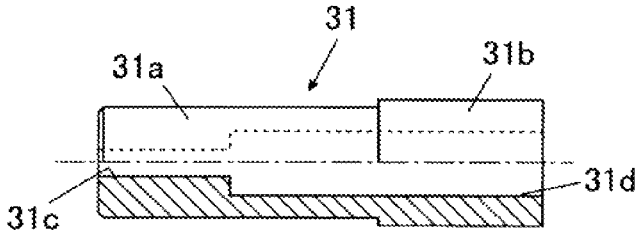
FIG. 6B is a partial cross-sectional side view of a key wrench holder of a fastening tool of an embodiment of the present invention.

As illustrated in FIG. 3, FIG. 4 and FIG. 6, the key wrench holder 31 is formed into a stepped cylindrical shape having a small-diameter section 31*a* and a large-diameter section 31*b*, and a through hole that runs along the center axis. On one end of that through hole there is a hexagonal hole 31*c* for holding an L-shaped key wrench 38, and in the remaining section there is circular hole 31*d* having a larger diameter than the hexagonal hole 31*c*. The small-diameter section 31*a* is inserted into the circular hole 21*c* of the socket wrench 21. The small-diameter section 31*a* is such that it is held inside the circular hole 21*c* so that it can rotate smoothly without backlash. As illustrated in FIG. 8, the length of the small-diameter section 31*a* is nearly the same as the length of the circular hole 21*c*, and the small-diameter section 31*a* is inserted until the stepped section comes in contact with the nut engagement hole 21*b* and circular hole 21*c*.

Figure 7A:
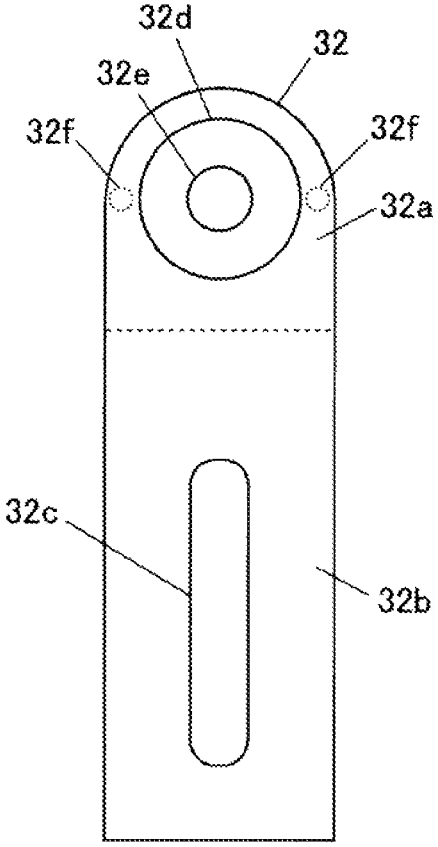
FIG. 7A is a top view.
Figure 7B:
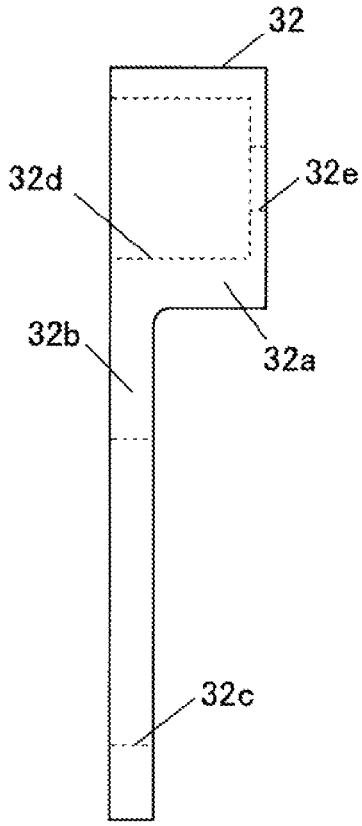
FIG. 7B is a side view of a bearing holder of a fastening tool of an embodiment of the present invention.

As illustrated in FIG. 3, FIG. 4 and FIG. 7, the bearing holder 32 comprises a bearing housing section 32*a* and an attachment plate section 32*b*. The bottom surface of the bearing holder 32 is a flat surface. A long hole 32*c* is formed in the attachment plate section 32*b*. The bearing housing section 32*a* is thicker than the attachment plate section 32*b*, so the top surface of the bearing holder 32 has a stepped shape.

A bearing support hole 32*d* is formed in the bearing housing unit 32*a* such that the opening is on the bottom surface of the bearing housing unit 32*a*. A small-diameter coil spring insertion hole 32*e* that is coaxial with the bearing support hole 32*d* is formed on the top surface. Furthermore, screw holes 32*f*, 32*f* are formed in the side wall portion of the bearing support hole 32*d*. The screw holes 32*f*, 32*f* are located such that they are on opposite sides of the center axis of the bearing support hole 32*d*, with the opening being on the top surface of the bearing housing unit 32*a*.

A one-way bearing 33 is fitted inside the bearing support hole 32*d*, and the large-diameter section 31*b* of the key wrench holder 31 is inserted inside the one-way bearing 33.

As illustrated in FIG. 1 and FIG. 2, the bottom surface of the bearing holder 32 comes in contact with the top surface of the output end section of the nut runner 2. Using the long hole 32*c* that is formed in the attachment plate section 32*b*, the bearing holder 32 is attached to the nut runner 2 by bolts 23, 23 and nuts 24, 24.

The L-shaped hexagonal key wrench 38 is a commercially available product, and has a long shaft section 38*a* and a short shaft section 38*b* that are continuous at a right angle forming an L shape, with the cross sectional shape being hexagonal.

The spring restraining plate 36 is a plate having a key wrench insertion hole 36*a* in the center, and a pair of screw insertion holes 36*b*, 36*b* on both sides of the key wrench insertion hole 36*a*. When the screw insertion holes 36*b*, 36*b* are arranged such that they are coaxial with the screw holes 32*f*, 32*f*, the key wrench insertion hole 31*a* is arranged such that it is coaxial with the coil spring insertion hole 32*e* of the bearing holder 32. The key wrench insertion hole 36*a* has a smaller diameter than the coil spring insertion hole 32*e*. The set collar 34*a*, coil spring 35 and the shaft section of the L-shaped hexagonal key wrench coil 38 pass through the spring insertion hole 32*e*. On the other hand, the key wrench insertion hole 36*a* has a size such that the set collar 34*a* and coil spring 35 cannot pass through it, however, the shaft section of the L-shaped hexagonal wrench can pass through it.

The long shaft section 38*a* of the L-shaped hexagonal key wrench 38 is sequentially inserted into the key wrench insertion hole 36*a* of the spring restraining plate 36, the coil spring 35 and set collar 34*a*, and the set collar 34*a* is attached to the long shaft section 38*a* by the set screw 34*b*. The attached set collar 34*a* controls the position of the tip end surface of the coil spring 35 with respect to the L-shaped hexagonal key wrench 38.

As illustrated in FIG. 8, the long shaft section 38*a* of the L-shaped hexagonal key wrench 38 to which the set collar 34*a*, coil spring 35 and spring restraining plate 36 are attached in this way is inserted into the coil spring insertion hole 32*e*, and next inserted into the circular hole 31*d* of the key wrench holder 31. The set collar 34*a* comes in contact with the stepped section between the circular hold 31*d* and the hexagonal hole 31*c*, and the long shaft section 38*a* that extends beyond the set collar 34*a* is inserted into the hexagonal hole 31*c*. The tip end of the long shaft section 38*a* protrudes to the outside from the nut engagement hole 21*b*. In FIG. 8, the coil spring 35 is compressed, so the set collar 34*a* is not in contact with the stepped section. When the set collar 34*a* is in contact with the stepped section, the length of the long shaft section 38*a* that protrudes from the nut engagement hole 21*b* becomes a maximum.

After the set collar 34*a*, the coil spring 35 and long shaft section 38*a* of the L-shaped hexagonal key wrench 38 have been inserted, the cap bolts 37, 37 are inserted into the screw insertion holes 36*b*, 36*b* in the spring restraining plate 36, and screwed into the screw holes 32*f*, 32*f*, which attaches the spring restraining plate 36 to the hearing holder 32. The attached spring restraining plate 36 controls the position of the rear end surface of the coil spring 35.

Next, the method of using the fastening tool 1 is explained.

First, the fastening tool 1 is assembled as described above, so that it is in the assembled state as illustrated in FIG. 1 and FIG. 2.

Figure 8A:
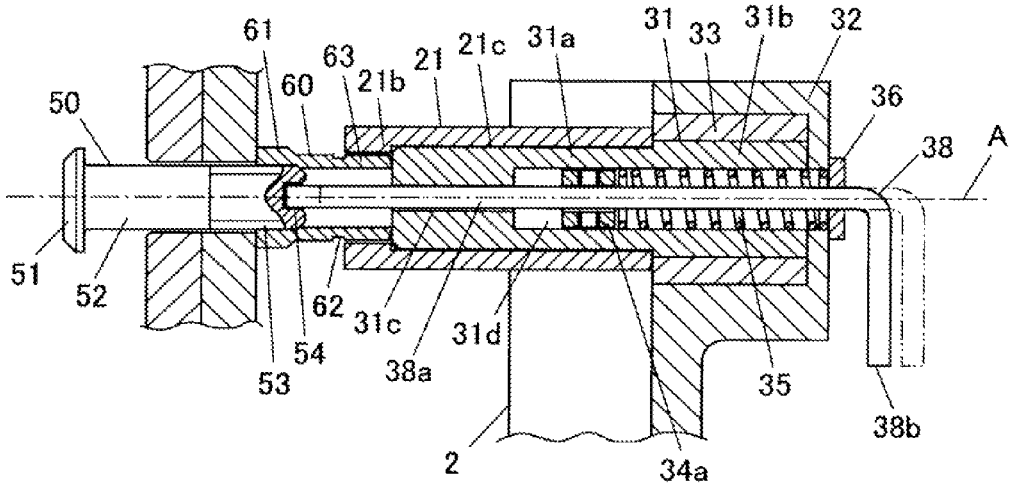
FIG. 8A and FIG. 8B are vertical cross-sectional diagrams illustrating states of the fastening work by a fastening tool of an embodiment of the present invention, where
Figure 8B:
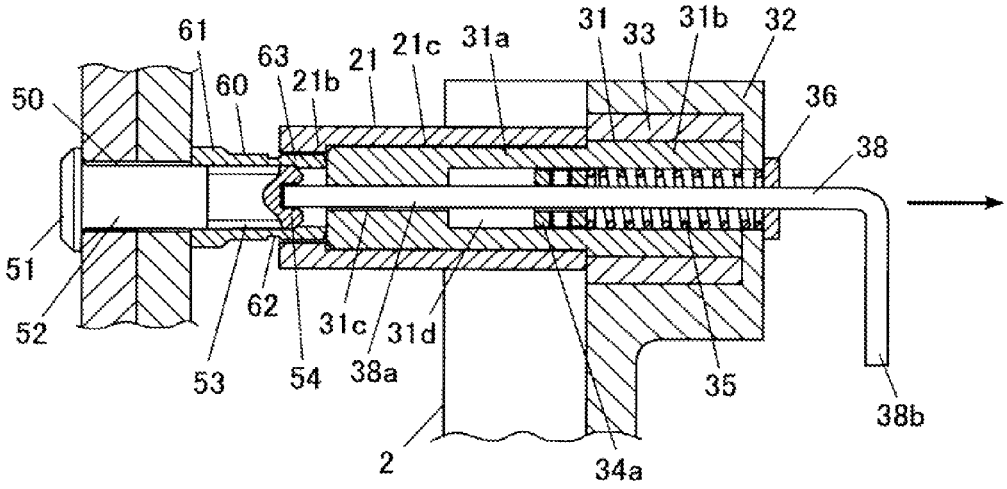

As illustrated in the cross-sectional drawing of FIGS. 8A, 8B, in a nut rotating tool that comprises a nut runner 2 and socket wrench 21, the rotating section that engages with and rotates the nut 60 is constructed with the socket wrench 21. A through hole is formed in the socket wrench 21 by way of a nut engagement hole 21*b* and circular hole 21*c*. This through hole is formed along the direction of the axis of rotation A, with the inner surface of the through hole surrounding the axis of rotation A. The key wrench holder 31 is capable of rotating around the axis of rotation A relative to the socket wrench 21. The large diameter section 31*b* of the key wrench holder 31 is held between the rear end surface of the socket wrench 21 and the top surface section of the bearing housing 32*a*. Moreover, the tip end surface of the small-diameter section 31*a* of the key wrench holder 31 comes in contact with the stepped section inside the socket wrench 21. As a result, the key wrench holder 31 is held so that it cannot move in the direction of the axis of rotation A.

The L-shaped hexagonal key wrench 38 is inserted into the hexagonal hole 31*c* of the key wrench holder 31, and is supported such that it is capable of moving in the direction of the axis of rotation A with respect to the key wrench holder 31, and is not capable of rotating around the axis of rotation A with respect to the key wrench holder 31. Therefore, the key wrench holder 31 and the L-shaped key wrench 38 rotate together.

The one-way bearing 33 supports the key wrench holder 31 such that it can freely rotate in one direction around the axis of rotation A with respect to the non-rotating section of the nut runner 2, and such that it cannot rotate in the opposite direction. This fastening tool 1 is a tool exclusive for fastening, so the direction in which rotation is not allowed by the one-way bearing 33 is the direction of rotation of the socket wrench 21 when fastening.

The coil spring 35 presses the L-shaped hexagonal wrench 38 toward the pin 50 side along the axis of rotation A. In other words, the coil spring 35 presses the L-shaped hexagonal wrench 38 toward the direction that the long shaft section 38*a* of the L-shaped hexagonal wrench 38 protrudes from the nut engagement hole 21*b* of the socket wrench 21.

Figure 9:
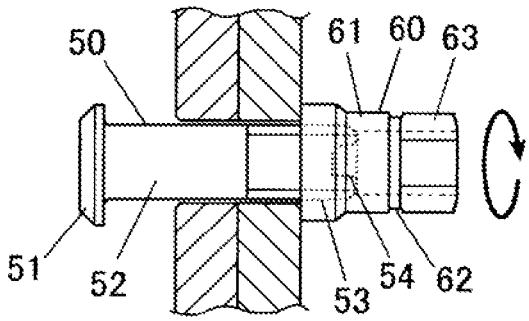
FIG. 9 is a side view of the conventional fascinating member.

On the other hand, the state illustrated in FIG. 9 is obtained by screwing together the pin 50 and nut 60 by hand.

Next, as illustrated in FIG. 8A, the axis of rotation A of the fastening tool 1 is aligned with the center axis of the pin 50 and nut 60, and the fastening tool 1 is brought close to the pin 50 and nut 60, then the L-shaped hexagonal wrench 38 of the fastening tool 1 is caused to engage with the pin 50, and the socket wrench 21 is caused to engage with the nut 60.

When doing this, while the nut 60 is engaged with the nut engagement hole 21*b* of the socket wrench 21, the nut comes in contact with the tip end surface of the key wrench holder 31. Therefore, the key wrench holder 31 supports the L-shaped hexagonal key wrench 38 by way of the hexagonal hole 31*c* on the tip end part of the key wrench holder 31 at a position adjacent to the tool engagement section 63 of the nut 60 so that it cannot rotate.

The maximum protruding length of the long shaft section 38*a* described above is adjusted during assembly by the attachment position of the set collar 34*a* so that when the nut engagement hole 21*b* of the socket wrench is engaged with the nut 60, the L-shaped hexagonal wrench 38 is engaged with the tool engagement hole 54.

The rear end section of the L-shaped hexagonal key wrench 38, or in other words the short shaft section 38*b* extends to the outside.

When the angles of the L-shaped hexagonal key wrench 38 and the pin 50 do no match and there is no engagement, the operator grips the short shaft section 38*b* and rotates the L-shaped hexagonal key wrench in the direction allowed by the one-way bearing 33. In doing so, the angles of the L-shaped hexagonal key wrench 38 and tool engagement hole 54 of the pin 50 become aligned and there is engagement. Moreover, by rotating the L-shaped hexagonal key wrench 38, it is possible to check by feel whether or not the L-shaped hexagonal key wrench 38 is engaged with the tool engagement hole 54.

Next, the rotation output from the nut runner 2 is started and the socket wrench 21 is rotated in the fastening direction of the nut 60. As a result, the socket wrench 21 and the engaged nut 60 rotate. When this happens, the pin 50 does not rotate toward the direction that the nut 60 rotates, and rotation is stopped by the operation of one-way bearing 33 by way of the L-shaped hexagonal wrench 38 and key wrench holder 31. Therefore, the pin 50 is screwed into the nut 60.

As illustrated in FIG. 8A and FIG. 8B, as the pin 50 is screwed into the nut 60, the L-shaped hexagonal key wrench 38 is pressed out by the pin 50. However, the key wrench holder 31 remains in contact with the nut 60. During the entire fastening work, the hexagonal hole 31*c* on the tip end part of the key wrench holder 31 supports the L-shaped hexagonal key wrench 38 at a position adjacent to the tool engagement section 63 of the nut 60 so that it cannot rotate. As the fastening work proceeds and the pin 50 comes close to the key wrench holder 31, the span loaded by the torsional torque of the L-shaped hexagonal key wrench 38 becomes short.

After the pin 50 has been screwed into the nut 60, torque is further applied from the output of the nut runner 2. As a result, the nut 60 is twisted off at the weak section 62, and the tool engagement section 63 separates from the female thread section 61. The female thread section 61 remains screwed and fastened to the pin 50. This completes the fastening work by the fastening tool 1.

With the embodiment described above, the more the fastening work proceeds, the key wrench holder 31 securely supports the L-shaped hexagonal wrench 38 at a position nearer to the pin 20.

The amount of torsional deformation of the tip end part of the L-shaped hexagonal key wrench 38 can be kept small, the L-shaped hexagonal key wrench 38 securely engages with the pin 50, and twisting off of the twist-off type nut that requires a large torque in the final stage of the fastening work can be completed.

Moreover, as described above, the rear end section of the L-shaped hexagonal key wrench 38 extends to the outside such that it can be rotated. Therefore, the key wrench 38 can be rotated independent of the nut rotation tool in the one direction allowed by the one-way bearing 33. Consequently, the workability of the work of engaging the key wrench 38 in the tool engagement hole 54 of the pin 50, and the work of checking whether or not the key wrench 38 is engaged with the tool engagement hole 54 of the pin 50 is improved.

In the embodiment described above, the specified shape for engagement between the key wrench 38 and pin 50, the specified shaft for engagement between the socket wrench 21 and the nut 60, and the specified shape for engagement between the socket wrench 21 and nut runner 2 are all hexagonal. However, as long as it is possible to form an engaged state in which torque can be transmitted, any shape such as other polygon shapes, or special shapes other than a polygon shape can be used of course.

Moreover, the key wrench can be embodied using other shapes instead of an L shape, such as an I shape, T shape, Y shape and the like, and the tip end part that engages with the pin 50 and the rear end section that is operated can be separate parts that are joined together or continuous.

Furthermore, the embodiment above is for a twist-off type nut, so the fastening tool 1 is constructed exclusively for fastening. However, in the case of a normal nut, or in other words, in the case of a type of nut of which the tool engagement section remains, construction can be such that the work of loosening the nut is also possible. In that case, instead of the one-way mechanism, a mechanism can be used in which the direction of allowed rotation and direction of prevented rotation can be switched as in a ratchet.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed is:

1. A fastening tool for rotating a nut in a specified rotational direction relative to a pin, by engaging with the pin and the nut, the pin having a male thread section and the nut being screwed on to the male thread section of the pin, the pin further having an engaging portion provided at a tip end surface in an axial direction of the male thread section, the fastening tool comprising:

a rotational member having a through hole extending along a rotational axis of the nut, the through hole having an opening on one end and an opening on the other end, the opening on the one end of the through hole configured to house the nut such that the one opening on the one end engages with the nut in the specified rotational direction and the engaging portion of the pin exposes in the through hole;

a pin engagement member, inserted into the through hole of the rotational member from the opening on the other end, for engaging with the engagement portion of the pin exposed inside the through hole;

a tool main body supporting the rotational member coaxially with the nut; and a one-way mechanism, attached to the tool main body, for supporting the pin engagement member coaxially with the nut, the one-way mechanism restricting the pin engagement member from rotating toward the specified rotational direction, and allowing the pin engagement member to rotate toward a direction opposite to the specified rotational direction, wherein the tool main body rotates the nut relative to the pin by driving the rotating member toward the specified rotational direction with respect to the pin engagement member; and wherein the pin engagement member comprises:

a cylindrical member supported coaxially with the nut by the one-way mechanism; and a key wrench that is inserted through the cylindrical member in an axial direction of the cylindrical member and engages with the cylindrical member in the specified rotational direction, and the key wrench that engages with the engagement portion of the pin exposed inside the through hole of the rotating member.

2. The fastening tool according to claim 1, wherein the key wrench is movable relative to the cylindrical member in the axial direction of the cylindrical member, and the fastening tool further comprises a biasing mechanism for pressing the key wrench toward the engagement portion of the pin in order to maintain engagement between the key wrench and the engagement portion of the pin.

3. The fastening tool according to claim 1, wherein the key wrench and the cylindrical member are engaging in the specified rotational direction inside the through hole of the rotational member.

4. The fastening tool according to claim 1, wherein a part of the key wrench protrudes from the cylindrical member, and the key wrench and cylindrical member are capable of rotating toward the direction opposite to the specified rotational direction by manually operating the part of the key wrench.

5. The fastening tool according to claim 1, wherein the cylindrical member is arranged so that the cylindrical member comes in contact with the nut in the axial direction of the cylindrical member when the rotating member houses the nut.

6. The fastening tool according to claim 1,wherein the key wrench engages with the cylindrical member so that it does not rotate around the axis of rotation with respect to the cylindrical member.

* * * * *